United States Patent [19]

Blazek et al.

[11] Patent Number: 5,020,585

[45] Date of Patent: Jun. 4, 1991

[54] BREAK-OUT DETECTION IN CONTINUOUS CASTING

[75] Inventors: Kenneth E. Blazek, Crown Point; Ismael G. Saucedo, Highland, both of Ind.

[73] Assignee: Inland Steel Company, Chicago, Ill.

[21] Appl. No.: 326,081

[22] Filed: Mar. 20, 1989

[51] Int. Cl.[5] ..... B22D 11/16

[52] U.S. Cl. ..... 164/452; 164/451; 164/150; 164/154

[58] Field of Search ..... 164/451–455; 164/150, 154, 413, 414, 449

[56] References Cited

U.S. PATENT DOCUMENTS

| | | | |
|---|---|---|---|
| 3,478,808 | 11/1969 | Adams | 164/454 |
| 3,537,505 | 11/1970 | Thalmann | 164/454 |
| 3,797,310 | 3/1974 | Babcock et al. | 164/454 |
| 4,235,276 | 11/1980 | Gilles et al. | 164/454 |
| 4,556,099 | 12/1985 | Yamamoto et al. | 164/453 |
| 4,674,556 | 6/1987 | Sakaguchi et al. | 164/454 |
| 4,774,998 | 10/1988 | Matsushita et al. | 164/453 |

FOREIGN PATENT DOCUMENTS

| | | | |
|---|---|---|---|
| 39068 | 3/1983 | Japan | 164/150 |
| 38763 | 2/1986 | Japan | 164/452 |
| 289954 | 12/1986 | Japan | 164/452 |

OTHER PUBLICATIONS

K. E. Blazek and I. G. Saucedo, "An Investigation of Sticker and Hanger Breakouts", 4th Intl. Conference on Continuous Casting, Brussels, May 17–19, 1988, pp. 668–681.

K. E. Blazek, I. G. Saucedo and H. T. Tsai, "An Investigation of Mold Heat Transfer During Continuous Casting", AIME, Toronto, Apr. 1988.

K. E. Blazek, "Mold Heat Transfer During Continuous Casting, Part I", Iron and Steelmaker, Sep., 1987.

K. E. Blazek, "Mold Heat Transfer During Continuous Casting, Part II", Iron and Steelmaker, Oct. 1987.

K. E. Blazek, "Mold Heat Transfer During Continuous Casting, Part IV", Iron and Steelmaker, Dec. 1987.

K. E. Blazel, "Mold Heat Transfer During Continuous Casting, Part VII", Iron and Steelmaker, Mar., 1988.

A. Tsuneoka, et al., "Measurement and Control System of Solidfication in Continuous Casting Mold", Steelmaking Conference Proceedings, AIME, 1985, pp. 3–10.

S. N. Singh and K. E. Blazek, "Heat Transfer and Skin Formation in a Continuous-Casting Mold as a Function of Steel Carbon Content", Journal of Metals, Oct., 1974.

S. N. Singh and K. E. Blazek, "Heat Transfer Profiles in Continuous-Casting Mold as a Function of Various Casting Parameters", Proceedings of the Open Hearth Conference, AIME, 1976, pp. 264–283.

F. Nakashige, et al., "Development of a Detection System for Sticking Type Breakouts in Continuous Casting of Stainless Steel", Nisshin Steel Tech. Rep., vol. 53, Dec., 1985, pp. 58–67.

*Primary Examiner*—Richard K. Seidel

*Assistant Examiner*—Edward A. Brown

*Attorney, Agent, or Firm*—Marshall, O'Toole, Gerstein, Murray & Bicknell

[57] ABSTRACT

A method and apparatus for predicting the likelihood of a break-out during continuous casting of molten metal in a vertical mold. A continuous determination is made of (a) the location within the mold of the molten metal level and (b) the peak temperature location within the mold, both in relation to the top of the mold. The vertical distance between (a) and (b) is noted, and that distance is continuously monitored to detect any increase therein. A substantial increase indicates the likelihood of a breakout unless corrective action is taken.

29 Claims, 4 Drawing Sheets

BREAK-OUT DETECTION IN CONTINUOUS CASTING

BACKGROUND OF THE INVENTION

The present invention relates generally to the continuous casting of molten metal and more particularly to the detection of break-outs during continuous casting.

In a continuous casting process, molten metal is continuously introduced into the top of a vertically disposed, liquid cooled, metal mold having open upper and lower ends. The metal descends through the mold, and partially solidified metal is continuously withdrawn from the bottom of the mold. More particularly, as molten metal descends through the mold, the metal in contact with the interior surface of the cooled mold is chilled to form a cast metal shell surrounding an interior of molten metal, and this is normally the form of the metal when it is withdrawn from the bottom of the mold. Conventional expedients are employed at the start of the casting operation to retain the metal within the mold until after there is solidification at the bottom of the shell.

As the shell descends through the mold, it thickens. During the casting process, a hot spot develops in the mold wall, slightly below the top surface of the molten metal in the mold, and that surface is typically maintained near the upper end of the mold. During initiation of a sticker or hanger-type break-out, as the cast metal shell descends through the mold, the hot spot similarly descends, at a slower rate, causing a gap in or thinning of the cast metal shell at the location of the descending hot spot. When the hot spot reaches the lower open end of the mold, a break-out of molten metal occurs. Break-outs are dangerous and wasteful.

There are two predominant types of break-outs: hangers and stickers. Hanger-type break-outs are caused by molten metal overflowing the top of the mold. Sticker-type break-outs are initiated when the upper part of the shell, or a portion thereof, gets stuck to the mold wall and tears apart from the rest of the descending shell.

A more detailed discussion of hot spots and break-outs and the considerations involved with respect thereto is contained in a paper by the present inventors entitled "An Investigation Of Sticker And Hanger Breakouts", 4th International Conference on Continuous Casting, Brussels, May 17–19, 1988, pp. 668–681, and the disclosure thereof is incorporated herein by reference.

In a typical commercial, vertically disposed, continuous casting mold, cooling liquid is circulated through vertically disposed channels in the mold sidewalls. In addition, a series of temperature sensors in the form of thermocouples are embedded within the side walls of the mold, at vertically spaced locations therein, to measure the temperature at each of these vertically spaced locations. These temperature measurements are indicative of the relative temperature of the metal shell within the mold at a respective vertical location on the mold.

There is a prior art procedure for predicting the likelihood of a molten metal break-out at the lower open end of the continuous casting mold. This procedure employs the arrangement of mold wall thermocouples described in the previous paragraph and utilizes, from each of several vertically spaced thermocouples, e.g., three thermocouples, a continuous temperature measurement which is plotted on a graph on which the vertical coordinate is temperature and the horizontal coordinate is time. The temperature versus time curves for the several thermocouples are plotted on the same graph. In a normal casting operation, where there is no danger of a break-out, the temperature reading should decrease progressively in descending order among the thermocouples. When a thermocouple near the top of the mold measures a brief rise followed by a drop in temperature, with time; and when this temperature behavior is repeated at each of the lower thermocouples, in descending order, sequentially, it means that there is a descending hot spot and that there is a danger of a break-out unless corrective action is taken. A typical corrective action is to slow or stop the withdrawal of the continuously cast shell from the mold, as this gives the metal in the shell an opportunity to freeze and/or thicken at the location of the hot spot.

A more detailed description of the break-out predicting procedure described above is contained in a paper by Tsuneoka, et al., "Measurement and Control System of Solidification in Continuous Casting Mold", Steelmaking Conference Proceedings, AIME, 1985, pp. 3–10, particularly at pp. 3–5.

A drawback to relying upon an arrangement of thermocouples embedded in the walls of the continuous casting mold, for predicting a break-out, is that these thermocouples are subjected to extremely severe service conditions and require frequent servicing or replacement. For that reason, they cannot always be relied upon to provide an accurate indication of the temperature conditions within the mold at all levels thereof, on a continuous basis.

Other break-out predicting devices and procedures, based on variations, with time, of mold friction or overall mold heat transfer rate, are not sufficiently reliable in predicting break-outs, and therefore should not be used for that purpose.

SUMMARY OF THE INVENTION

Methods and apparatuses in accordance with the present invention avoid the drawbacks and defects inherent in the prior art procedures for predicting a break-out.

In its broadest aspect, the present invention comprises a method and apparatus wherein a continuous determination is made of (a) the location of the molten metal level within the mold and (b) the peak temperature location within the mold, both in relation to the top of the mold; the vertical distance between (a) and (b) is noted; and that distance is continuously monitored to detect any increase therein. A substantial increase in that distance indicates the likelihood of a break-out unless corrective action is taken.

In one embodiment, the location of the peak temperature may be determined by employing a multiplicity of temperature sensors at vertically spaced locations in the mold wall between the upper and lower mold ends. In another embodiment, temperature sensors in the mold wall are unnecessary.

In the latter embodiment, the continuous casting mold does not employ vertically disposed channels for circulating a cooling fluid. Instead, the mold employs a multiplicity of vertically spaced, horizontally disposed, cooling channels at locations between the upper and lower mold ends. Cooling liquid is circulated through these channels. Temperature sensors are employed to measure temperatures, but none of the temperature sensors so employed is located within the sidewalls of the mold, thereby eliminating exposure of the temperature sensors to the service conditions which occur when the temperature sensors are embedded within the sidewalls of the continuous casting mold.

More particularly, in a preferred embodiment of the present invention, one or more temperature sensors are employed to continuously measure the temperature of the cooling liquid entering the horizontal cooling channels, throughout the continuous casting operation. Temperature sensors are also employed to continuously measure the temperature of the liquid exiting each of these cooling channels, with a separate measurement being made for each of the channels, and these temperature measurements also occur throughout the casting operation. Preferably, the flow rate of the cooling liquid in each of the cooling channels is measured, throughout the casting operation. All of these measurements are made outside the mold where service conditions are relatively benign.

The temperature differential of the cooling liquid for each of the horizontal channels is calculated, based upon the cooling liquid entry temperature and the cooling liquid exit temperature for that channel. This temperature differential, together with the flow rate of the liquid entering that channel, can be used to calculate the mold heat transfer rate (MHTR) for that channel. The continuous measurements of temperature and flow rate enable one to calculate instantaneous values for the temperature differentials and the MHTRs, on a continuous basis.

When care is exercised to assure that an equal volume of cooling liquid is constantly directed to each cooling channel, measurement of the flow rate in each channel may be unnecessary, and it will suffice to measure the flow rate of the cooling liquid before it is divided into a plurality of streams, each directed to a respective channel. Where the cooling liquid flow rate through each cooling channel is the same, one may dispense with calculating MHTR and instead employ the cooling liquid temperature differential for each channel in the steps described below. However, employment of MHTR is preferred.

In all embodiments, a determination is made of the location of the molten metal level in the mold, in relation to the top of the mold, continuously throughout the casting operation. Once all of the data described above has been obtained, the next step is to plot a curve on a graph on which (a) one coordinate is the mold wall temperature or the MHTR or the cooling liquid temperature differential and (b) the other coordinate is the vertical distance from the top of the mold. This curve portrays the variation in mold wall temperature or MHTR or temperature differential along the vertical dimension of the mold, between the upper and lower ends of the mold. Also depicted on the graph is the location of the molten metal level in relation to the top of the mold.

The curve described in the preceding paragraph is periodically changed to reflect change in the mold wall temperatures or MHTRs or temperature differentials. Similarly, the depiction of the molten metal level on the graph is periodically changed to reflect change, if any, in the location of the molten metal level in relation to the top of the mold.

From the information represented on the graph, one notes, from the appropriate coordinate, the vertical distance between (a) the location of the peak mold wall temperature or the peak MHTR or the peak temperature differential and (b) the location of the molten metal level. During normal operation (a) the location of the peak in the temperature differential or in the MHTR or in the mold wall temperature will be just below (b) the location of the molten metal level. In other words, the distance between the two will be small. Any increase in that distance is detected. If there is a progressive, continuous increase in that distance, and the increase is substantial, it is an indication that a hot spot has formed and is moving progressively down the mold. It also indicates a likelihood of a break-out of molten metal at the bottom of the continuous casting mold, unless corrective action is taken. When corrective action is taken, and the descending hot spot is eliminated, the distance between (a) the molten metal level location and (b) the location of the peak in mold wall temperature or MHTR or temperature differential will, in time, return to the normal, relatively small spacing between the two.

A method in accordance with the present invention preferably employs a computer and associated display equipment (e.g., a cathode ray tube screen), to perform the appropriate calculations, curve plotting, and graphic displays. An appropriate visual or audible alarm can be actuated by the computer when the distance between (a) the molten metal level location and (b) the location of the peak mold wall temperature or the peak MHTR or peak temperature differential increases by a predetermined amount.

Break-out predicting methods and apparatuses in accordance with the present invention are useful in predicting both so-called hanger-type and sticker-type break-outs.

Other features and advantages are inherent in the method and apparatus claimed and disclosed or will become apparent to those skilled in the art from the following detailed description in conjunction with the accompanying diagrammatic drawings.

DETAILED DESCRIPTION

Figure 1:
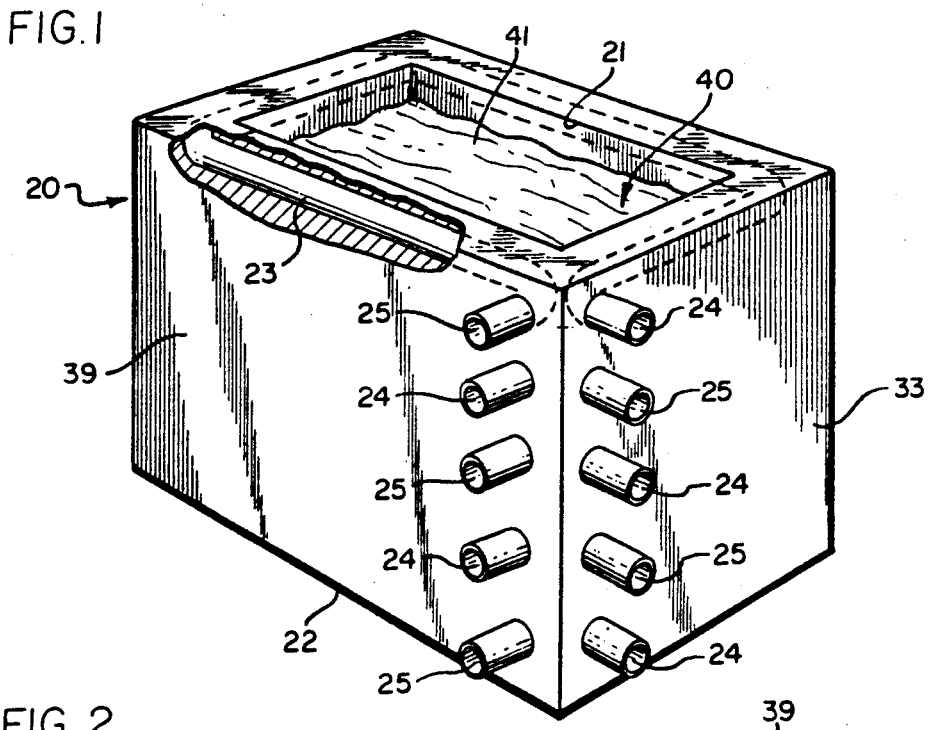
FIG. 1 is a perspective of a continuous casting mold employed in an embodiment of the present invention.
Figure 2:
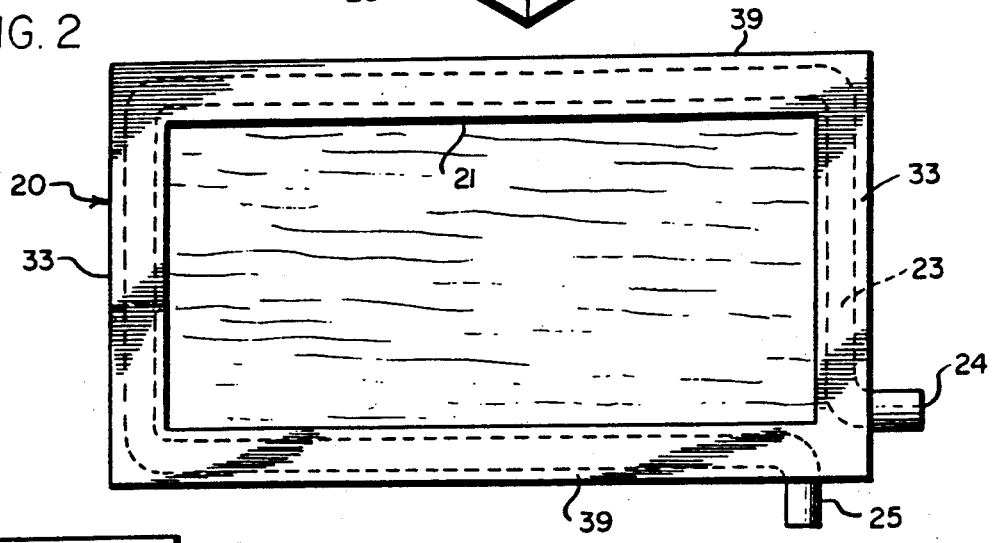
FIG. 2 is a plan view of the mold of FIG. 1.
Figure 7:
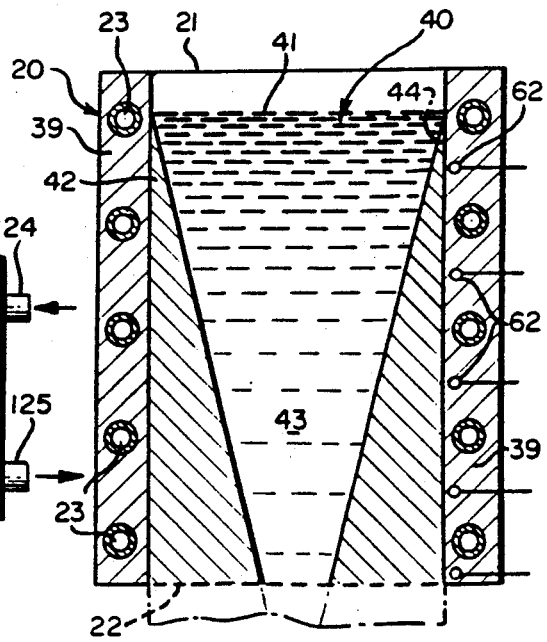
FIG. 7 is a fragmentary sectional view of the mold of FIG. 1.

Referring initially to FIGS. 1, 2 and 7, indicated generally at 20 is a continuous casting mold constructed in accordance with an embodiment of the present invention. Mold 20 is typically composed of copper. It has end walls 33, 33 and side walls 39, 39 defining a rectangular horizontal cross-section (FIG. 2), an open upper end 21 and an open lower end 22. Mold 20 comprises a multiplicity of vertically spaced, horizontally disposed, internal cooling channels 23, 23 at locations between upper and lower mold ends 21, 22. Communicating with each cooling channel 23 is an inlet 24 and an outlet 25. In the embodiment of FIG. 1, the inlets 24, 24 and outlets 25, 25 are vertically stacked, in alternating relation, to alternate, in vertical sequence, the direction of flow of cooling liquid through channels 23, 23.

Figure 3:
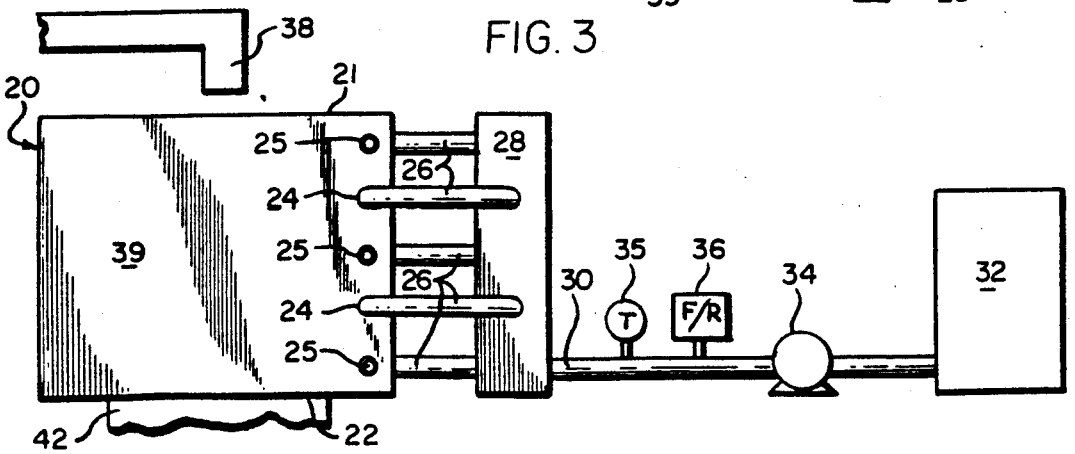
FIG. 3 is a schematic diagram illustrating an embodiment of the present invention.
Figure 4:
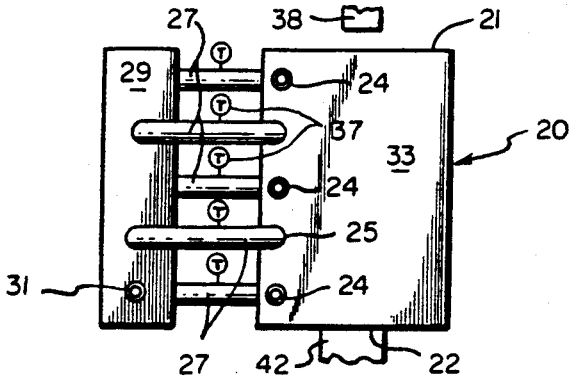
FIG. 4 is a fragmentary schematic end view illustrating a portion of an embodiment of the invention.

Referring to FIG. 3, each inlet 24 is connected by an inlet line 26 to an inlet header 28 connected by a main line 30 to a cooling liquid source 32 (e.g., a tank or reservoir or domestic water main). Referring to FIG. 4, each outlet 25 is connected by a conduit 27 to an outlet header 29 connected by a line 31 to a drain or a recycling system for the cooling liquid, for example, neither of which is shown. A pump 34 on main line 30 circulates cooling liquid through line 30, inlet header 28, inlet conduits 26, 26, inlets 24, 24, cooling channels 23, 23, outlets 25, 25, outlet conduits 27, 27, outlet header 29 and outlet line 31.

As shown in FIG. 3, located along line 30 are a temperature sensor 35 and a flow rate measurement device 36. Items 35 and 36 are conventional devices readily available from equipment suppliers. Referring to FIG. 4, located on each of outlet conduits 27, 27 is a temperature sensor 37 such as that employed at 35 on line 30. Referring to both FIGS. 3 and 4, located above the open upper end 21 of mold 20 is a device 38 for determining the molten metal level within mold 20. Device 38 is a conventional piece of equipment readily available from equipment suppliers.

Device 36 enables one to continuously measure the flow rate of the cooling liquid entering channels 23 as well as everything upstream of channels 23, including inlets 24, inlet conduits 26, inlet header 28 and main line 30. Temperature measuring device 35 enables one to continuously measure the temperature of the liquid entering cooling channels 23, as well as everything upstream of cooling channels 23. Temperature measuring devices 37, 37 enable one to continuously measure, separately for each channel, the temperature of the liquid exiting each channel 23. Device 38 enables one to continuously determine the molten metal level in mold 20.

The embodiment illustrated in FIGS. 3–4 is one in which the volume of cooling fluid flowing from inlet header 28 into each inlet conduit 26 is equal for each conduit 26 at all times, thereby assuring an equal flow rate through each channel 23. In such a case, only one flow rate measurement need be made for all the channels, e.g., on line 30. In other embodiments, the flow rate may be measured separately for each channel, e.g., at each inlet conduit 26 with a respective device 36. Similarly, instead of measuring the cooling liquid inlet temperature at one inlet location, e.g., on line 30, the inlet temperature may be measured separately for each cooling channel 23, e.g., at each inlet conduit 26 with a respective temperature sensor 35. More than one inlet header 28 may be used, each such header connected to one or more inlet conduits 26, in which case there may be a need for a flow rate measuring device 36 for at least each header.

In a continuous casting process, molten metal, indicated generally at 40 in FIGS. 1 and 7, is introduced through the open upper end 21 of mold 20 and substantially fills the mold following which metal is continuously withdrawn through lower open mold end 22. The mold is cooled by cooling liquid (e.g., water at ambient or lower temperatures) circulated through cooling channels 23. As molten metal 40 descends through the mold, the metal in contact with the interior surface of the cooled mold is chilled to form a cast metal shell 42 surrounding an interior 43 of molten metal, and this is normally the form of the metal as it is withdrawn from the lower open end 22 of mold 20. As shown in FIG. 7, shell 42 thickens as it descends through the cooled mold. Molten metal 40 has a top surface 41 normally maintained near the mold's open upper end 21.

During casting, a hot spot, indicated at dash-dot lines at 44 in FIG. 7, develops in the mold wall. Hot spot 44 typically originates slightly below top surface 41 of the molten metal in the mold. In the presence of conditions which can cause a hanger-type or sticker-type break-out, the following action occurs. As cast metal shell 42 descends through mold 20, hot spot 44 similarly descends, at a slower rate usually one-half that of shell 42, causing a gap in or a thinning of cast metal shell 42 at the location of the descending hot spot. The descent of the hot spot through the mold continues until the hot spot reaches lower open end 23 at which time a break-out of molten metal occurs.

Break-outs can be prevented if they can be detected early enough. Expedients for preventing break-outs include slowing the rate at which the cast metal shell is withdrawn from the mold or, in accordance with the present invention, raising the level or top surface 41 of metal 40 within mold 20.

The structure and equipment described above are employed in accordance with one embodiment of the present invention to detect the locations of hot spots and predict the likelihood of a break-out. Also employed for this purpose are additional expedients, described below.

Another embodiment of the present invention employs temperature sensors such as thermocouples 62 in the walls of mold 20, at a multiplicity of vertically spaced locations between the upper and lower mold ends 21, 22 (see FIG. 7). The thermocouples may be located between cooling channels 23, for example, or at the locations of cooling channels 23 in an embodiment in which the mold employs vertical cooling channels. The vertical row of thermocouples may be located in mold sidewall 39 (FIG. 7) or in endwall 33, or two or more vertical rows of thermocouples may be located in two or more mold walls.

Figure 5:
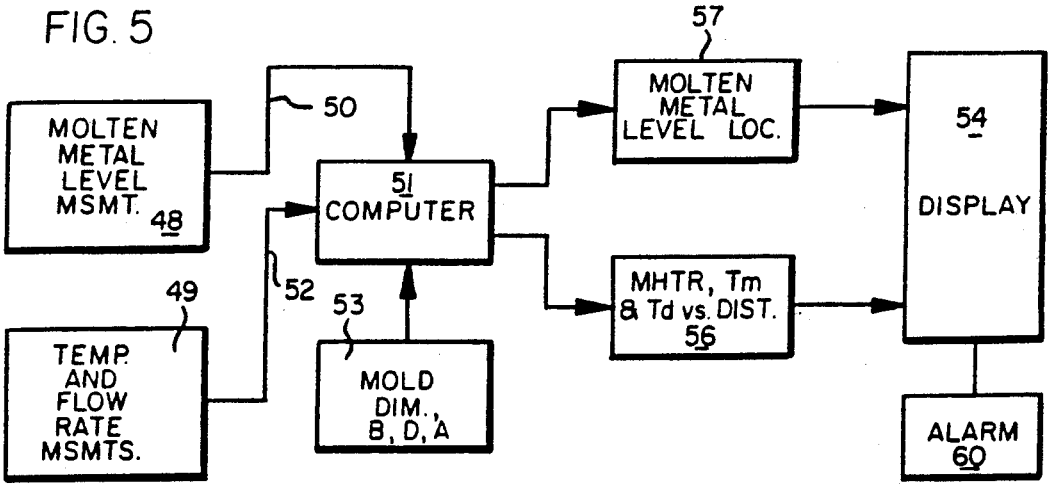
FIG. 5 is a block diagram illustrating a method in accordance with the present invention.

FIG. 5 is a block diagram illustrating embodiments of the method of the present invention. The molten metal level measurements made with device 38 are represented diagrammatically at block 48. The temperature and flow rate measurements made by temperature measuring devices 35 and 37 and by flow rate measuring device 36 are represented diagrammatically at block 49. The mold wall temperature measurements made by thermocouples 62 are also included within the measurements represented by block 49. All of these measurements 48, 49 are fed by conventional circuitry 50, 52 respectively to a conventional computer 51. Manually set into computer 51 is the predetermined vertical dimension of mold 20, and this information is represented diagrammatically at block 53.

Computer 51 is of a conventional nature and comprises conventional circuitry which can be programmed to perform each of the functions described below. The computer calculates, from the temperature and flow rate measurements 49 fed into computer 51, the mold heat transfer rate (MHTR) at each of channels 23. The equation for calculating MHTR is as follows:

$$MHTR = \frac{F/R \times B \times Td \times D}{A}$$

MHTR is expressed as $kW/m^2/sec$.

F/R is the volumetric flow rate of the cooling liquid in an individual cooling channel 23, and F/R is expressed as liters/sec.

B is the heat capacity of the cooling liquid (e.g., water), and B is expressed as kilojoules/K°/g.

Td is the temperature differential for the cooling liquid in an individual channel 23. The temperature differential is the difference between the channel's inlet temperature, e.g., as measured at 35, and the channel's outlet temperature, e.g., as measured at 37. Td is expressed as K°.

D is the density of the cooling liquid, and D is expressed as $g/m^3$.

A is the area of mold interior surface cooled by an individual cooling channel 23, and A is expressed as $m^2$.

In the above-noted equation, B, D and A are constants, so that if F/R is the same for each cooling channel, Td may be used in lieu of MHTR. B, D and A are normally manually set into the computer, and this is represented at block 53 in FIG. 5.

The information developed by computer 51, from the data fed to it, includes the location of the molten metal level in relation to the top of the mold, represented by block 57 in FIG. 5, and the following information represented by block 56 in FIG. 5: the MHTR for each cooling channel 23, or alternatively, the temperature differential (Td) for each channel 23, or the mold wall temperature ($T_m$ for each thermocouple 62), each of the foregoing in relation to the distance from the top of the mold.

Figure 8:
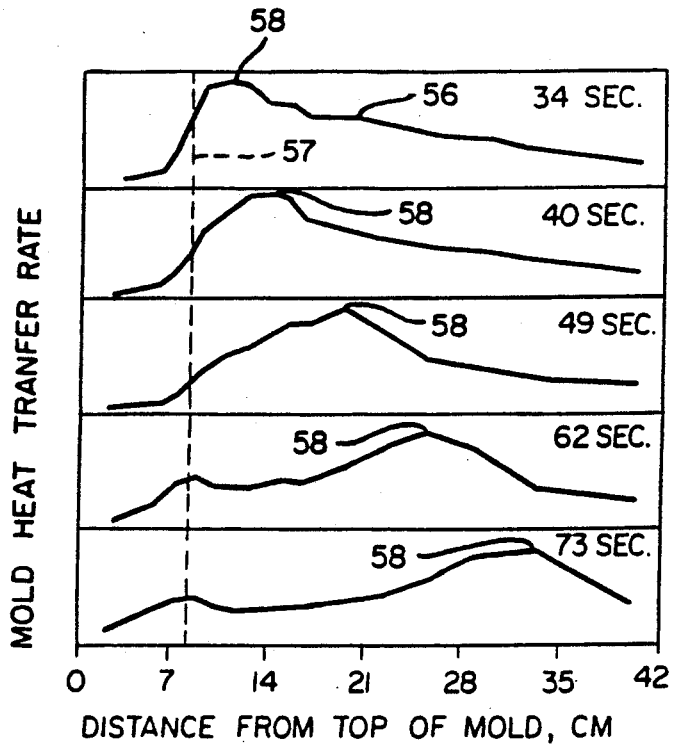
FIG. 8 is a series of graphs illustrating a display in accordance with one embodiment of the present invention.
Figure 9:
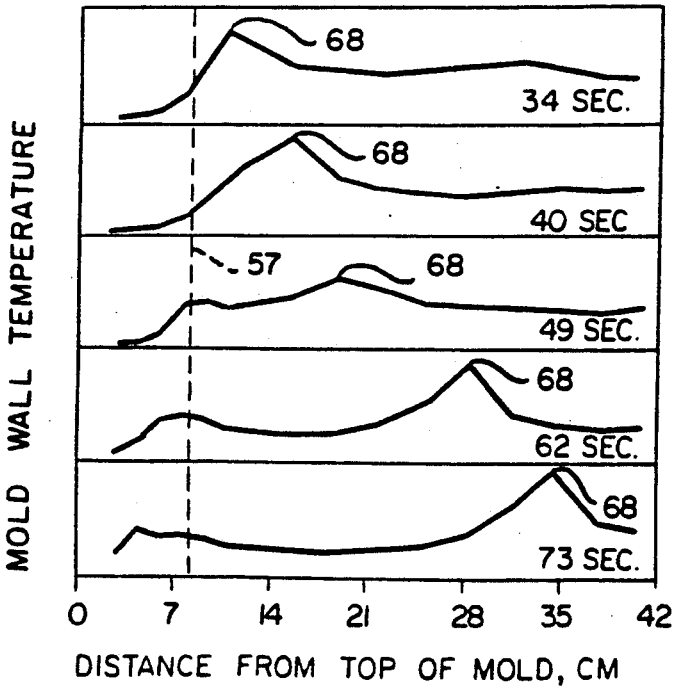
FIG. 9 is a series of graphs illustrating a display in accordance with another embodiment of the present invention.

Connected to computer 51 and cooperating therewith is a conventional display device 54, such as a conventional cathode ray tube screen. Computer 51 and display device 54 cooperate to display a graph in which one coordinate is MHTR or mold wall temperature and the other coordinate is the vertical distance from the top of the mold (FIGS. 8 and 9). Alternatively, in lieu of MHTR, the one coordinate can be the temperature differential of the cooling liquid, when the circumstances for such a substitution are appropriate.

Computer 51 and display device 54 cooperate to plot, on the graph described in the preceding paragraph, a curve showing the variation in MHTR, or in mold wall temperature, along the vertical dimension between upper mold end 21 and lower mold end 22 (FIGS. 8 and 9). Computer 51 and display device 54 also cooperate to depict, on the graph, the location 57 of the molten metal level in relation to the top of the mold (noted as "liquid level" in FIGS. 10 and 11).

The computer is programmed to periodically change the curve plotted on the graph, to reflect a change in the MHTR's or in the mold wall temperatures. Similarly, the computer is programmed to periodically change the depiction of the molten metal level on the graph, to reflect a change in the location of the molten metal level in relation to the top of mold 20. Computer 51 is programmed to note, from the information represented on the curve, the vertical distance between (a) the peak MHTR (58 in FIG. 8) or the peak mold wall temperature (68 in FIG. 9) and (b) molten metal level 57. The computer includes circuitry programmed to detect any increase in that distance.

The likelihood of a molten metal break-out occurring at mold lower end 22 can be predicted, in accordance with one embodiment of the present invention, by following a method including the steps described below. During the casting operation, a cooling liquid is continuously circulated through channels 23, 23. The flow rate of the liquid entering each of the channels 23, 23 is measured continuously throughout the casting operation. The temperature of the liquid entering each of the channels 23, 23 is continuously measured throughout the casting operation. Also continuously measured throughout the casting operation is the temperature of the liquid exiting each of the channels 23, 23, separately for each channel 23 at its respective temperature measuring device 27. Computer 51 is employed to continuously calculate, from the data obtained in the measuring steps described above, the mold heat transfer rate (MHTR) at each channel 23

The method also includes continuously determining the molten metal level in mold 20, throughout the casting operation, employing device 38. Referring to FIG. 8, the method comprises plotting, on a graph in which the Y coordinate is the MHTR and the X coordinate is the vertical distance from the top of mold 20, a curve 56 showing the variation in MHTR along the vertical dimension between the upper and lower ends of the mold. The method further comprises depicting, on the graph, the location 57 of the molten metal level in relation to the top of the mold. Curve 56 is periodically changed to reflect change in the MHTRs. The depiction 57 of the molten metal level is periodically changed to reflect change, if any, in the location of the molten metal level in relation to the top of the mold.

As can be seen from FIG. 8, there is a peak MHTR at 58 on curve 56. From the information represented on the graph, the vertical distance (i.e., the distance along the X coordinate in FIG. 8) between (a) the location of peak MHTR 58 and (b) molten metal level location 57 is noted; and any increase in that distance is detected.

Under normal operating conditions, in the absence of a hot spot, the vertical distance between the location of peak MHTR 58 and molten metal level location 57 is relatively small, e.g., between ¾" and 2" (1.9–5.1 cm). If there is a progressive, continuous increase in the vertical distance between the location of peak MHTR 58 and molten metal level location 57, and the increase is substantial, that is an indication that a hot spot has formed and is moving progressively down the mold. It is also an indication of the likelihood of a break-out of molten metal at lower mold end 22, unless corrective action is taken.

A substantial increase in the vertical distance between the location of peak MHTR 58 and molten metal level location 57, is something greater than an increase of about 3" (7.6 cm), depending upon the vertical dimension of the mold. Typically, if the vertical distance between 57 and 58 becomes greater than 15% of the vertical dimension of the mold, one may conclude that there has been a substantial increase, and corrective action should be taken to prevent a break-out.

The computer can be programmed to actuate an alarm 60 (FIG. 5) when there is a substantial increase in the vertical distance between the location of peak MHTR 58 and molten metal level location 57. The alarm can be an audible alarm or it can be a visual alarm, for example a change in the background color on the screen of display device 54. In a preferred embodiment, the change in background color on the screen can occur in two different stages, one a warning stage (e.g., the color yellow) to alert an observer that a dangerous condition may be in the making, and the second stage a change to a second color (e.g., red), indicating that a break-out is imminent unless corrective action is taken.

The data reflected in FIGS. 8–11 were obtained from a small-scale continuous casting apparatus which produces billets having a square, horizontal cross-section measuring 8.3 cm on each side. The heat size was 136 kg. The mold had a vertical dimension of 45.7 cm. The mold was composed of oxygen-free copper and had a straight, untapered interior. The interior of the mold was lubricated with a lubricating oil conventionally employed for continuous casting. The liquid level aim was 7.5 cm (3") from the top of the mold during casting.

The mold had 27 continuous, evenly spaced, horizontally disposed cooling liquid channels 23, 23 which ran around the entire perimeter of the mold cavity. The cooling liquid flow direction around the mold periphery was alternated 15 times between the top and the bottom of the mold, to prevent mold distortion. The cooling liquid passages were 11 mm in diameter and were located 4.83 mm from the hot, interior surface of the mold. Inlet and outlet cooling liquid temperatures were measured at appropriate locations employing conventional resistance temperature devices, and the cooling liquid flow rate was continuously monitored at appropriate locations by conventional electronic flow meters.

During casting, the mold wall temperature was continuously measured with 16 vertically spaced thermocouples located 3 mm from the hot interior surface of the mold. This was done to enable a comparison between (1) a graph plotting MHTR versus distance from the top of the mold and (2) a graph plotting mold wall temperature versus distance from the top of the mold, to confirm that the first type of graph is as accurate a portrayal of the development and propagation of a hot spot as is the second type of graph. The first type of graph, MHTR versus distance from the top of the mold, is shown in FIG. 8. The second type of graph, mold wall temperature versus distance from the top of the mold, is shown in FIG. 9. In FIG. 8, the scale on the Y axis for MHTR is 0–2400 $kW/m^2/sec.$ for each time sequence. In FIG. 9, the scale on the Y axis for mold temperature is 0°–240° C. for each time sequence. The mold wall temperature measurements were fed into the same computer as were the measurements for calculating MHTR.

Both FIGS. 8 and 9 illustrate what was shown on a display screen at five different time sequences during the casting operation. The time interval between each sequence illustrated in FIGS. 8 and 9 varies between 6 seconds and 13 seconds. In actual practice, the display on the screen is changed at more frequent intervals, e.g., at less than 5-second intervals although up to 10-second intervals may be employed depending upon the processing and equipment parameters in use at a given time, for example. A time interval as low as 1 second may be employed. Preferably, the screen simultaneously displays curves reflecting data at two successive time intervals to facilitate a comparison between the data at the two time intervals and to facilitate a detection of any change in the distance between the peak MHTR and the location of the molten metal level.

As one can see by a comparison of FIG. 8 and FIG. 9, the graphs in the two figures track each other quite closely.

As the casting operation proceeded, normal conditions prevailed up to and including about 32 seconds into the casting operation. In other words, both the peak MHTR 58 (FIG. 8) and the peak mold wall temperature 68 (FIG. 9) were located only an insubstantial vertical distance apart from molten metal level location 57. At 34 seconds, a hot spot (the peak in both graphs) started to propagate down the length of the mold, while molten metal level 57 remained in substantially the same location. In the casting operation depicted in FIGS. 8 and 9, no corrective action was taken, and the hot spot was allowed to proceed to a break-out a the lower end of the mold.

Figure 11:
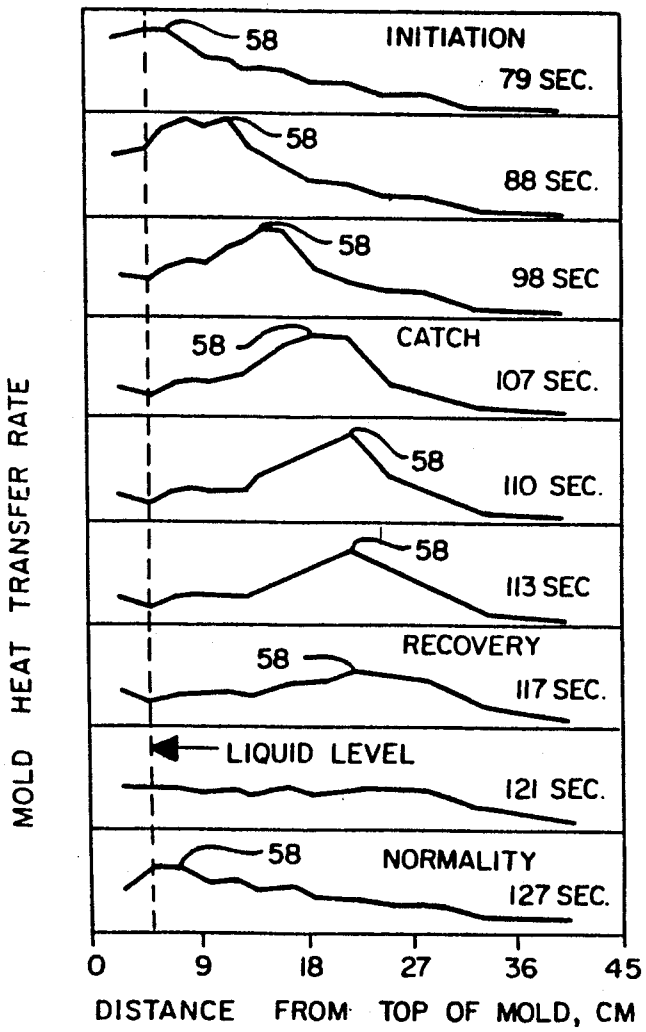
FIG. 11 is a series of graphs, plotting mold heat transfer rate versus distance from the top of the mold, and showing the initiation and prevention of a break-out.
Figure 10:
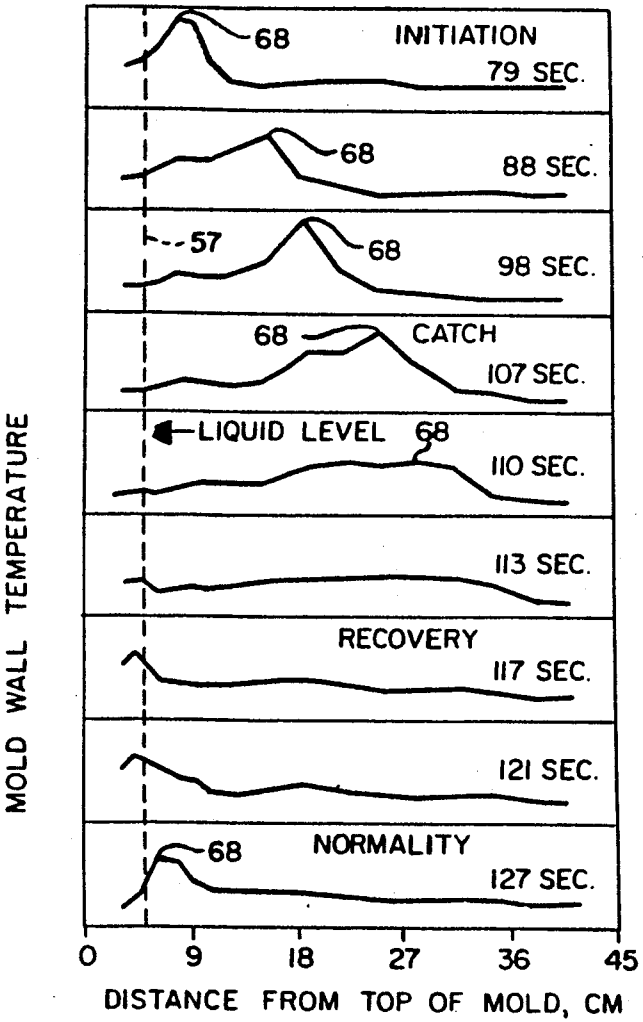
FIG. 10 is a series of graphs plotting mold wall temperature versus distance from the top of the mold, and illustrating the initiation and prevention of a break-out

FIGS. 10 and 11 illustrate a sequence of displays in which the hot spot was not allowed to proceed to break-out, but rather the necessary corrective action was taken. In FIG. 10, which plots mold wall temperature on the Y coordinate and distance from the top of the mold on the X coordinate, the temperature scale on the Y coordinate is between 25° C. and 275° C. for each time interval. In FIG. 11, which plots MHTR versus distance from the top of the mold, the scale on the Y coordinate (MHTR) is 400–2500 $kW/m^2/sec.$ As the continuous casting process progressed, conditions were normal up to and including about 77 seconds into the process. At that time interval, the locations of both the MHTR peak 58 (FIG. 11) and the mold temperature peak 68 (FIG. 10) were only about 2 cm from molten metal level location 57. Initiation of a descending hot spot occurred at about 79 seconds into the casting process. The hot spot propagated down the continuous casting mold until about 110 seconds into the casting operation. Corrective action was instituted at about 107 seconds when the rate of withdrawal of metal from the mold was slowed substantially. After corrective action was taken at 107 seconds, both the mold wall temperature peak 68 and the MHTR peak 58 lessened with increasing time, reflecting a recovery from the abnormal hot spot condition. Eventually, at 127 seconds into the casting operation, normality returned, with both the mold temperature peak 68 and the MHTR peak 58 being located only a very short distance from the molten metal level location 57.

As noted above, FIGS. 8 and 11 plot MHTR versus distance from the top of the mold, but a graph of the same shape would occur if one were to plot the cooling liquid temperature differential versus distance from the top of the mold, under conditions (described above) in which it was appropriate to substitute temperature differential for MHTR.

It is important, in order to predict the likelihood of a break-out, that MHTR or mold wall temperature be plotted against distance from the top of the mold. A plot of mold friction versus time or a plot of mold overall MHTR versus time will reflect conditions other than hot spots, in addition to reflecting hot spots, so that the latter two plots are not reliable indicia of the likelihood of break-outs. In a graph plotting MHTR versus distance from the top of the mold, or mold wall temperature versus distance from the top of the mold, a movement in the location of the peak MHTR or peak mold wall temperature a substantial distance away from the location of the molten metal level, is an indication of the likelihood of a break-out, and nothing else. No other condition, except the likelihood of a break-out, will cause (a) the location of the peak MHTR or the peak mold wall temperature to move away from (b) the location of the molten metal level.

FIGS. 8–11 indicate that a plot of mold MHTR versus distance from the top of the mold is as good a prediction of the likelihood of break-out as is the plot of mold wall temperature versus distance from the top of the mold while eliminating the disadvantages attending thermocouples emplaced within mold walls. In contrast, MHTR can be measured outside of the mold by employing flow rate meters and temperature sensors located on inlet and outlet lines for the cooling liquid.

Figure 6:
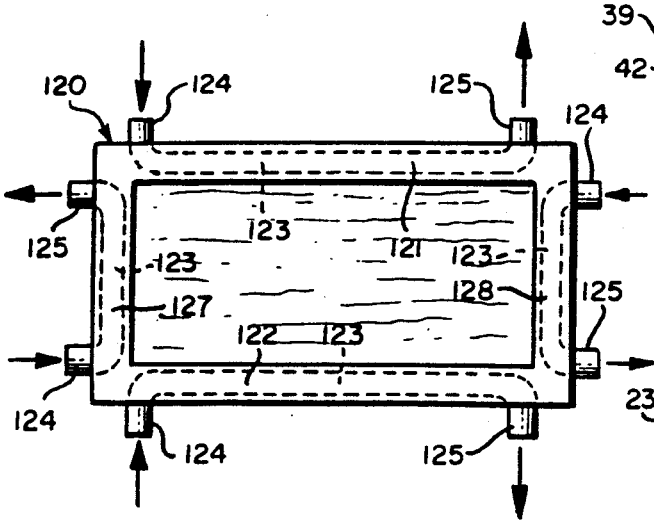
FIG. 6 is a plan view, similar to FIG. 2, illustrating another embodiment of a mold for use in accordance with the present invention.

The embodiment of mold 20 illustrated in FIGS. 1 and 2 employs a single cooling liquid inlet 24 and a single cooling liquid outlet 25 at each horizontal level. In the embodiment of mold illustrated in FIG. 6 at 120, there is a separate cooling liquid inlet 124 and a separate cooling liquid outlet 125 for each wall of the mold. In addition, mold 120 has a separate cooling channel 123 in each side wall 121, 122 and in each end wall 127, 128. An arrangement of the type illustrated in FIG. 6 enables one to more closely control the temperature in each wall of the continuous casting mold, compared to the control one can exercise employing an arrangement of the type illustrated in FIGS. 1 and 2.

The foregoing detailed description has been given for clearness of understanding only, and no unnecessary limitations should be understood therefrom, as modifications will be obvious to those skilled in the art.

We claim:

1. In a continuous casting process for forming a cast metal shell, wherein molten metal descends through and is withdrawn from a vertically disposed, liquid-cooled mold having walls, an upper end, an open lower end, and a predetermined vertical dimension, a method for predicting the likelihood of a molten metal break-out from said shell, at said lower end of the mold, said method comprising the steps of:

continuously determining the location of the molten metal level in said mold, in relation to the top of the mold;

continuously determining the location of the peak temperature within the mold, in relation to the top of the mold;

noting the vertical distance between (a) said peak temperature location and (b) said molten metal level location;

and continuously monitoring said vertical distance to detect any increase therein.

2. A method as recited in claim 1 wherein said step of determining the location of said peak temperature comprises:

measuring the mold wall temperature at each of a multiplicity of vertically spaced locations between said upper and lower mold ends.

3. A method as recited in claim 1 and comprising:

providing said mold with a multiplicity of vertically spaced, horizontally disposed, cooling channels at locations between said upper and lower mold ends;

and circulating cooling liquid through each of said channels.

4. A method as recited in claim 3 wherein:

said cooling liquid is circulated at the same flow rate through each of said channels;

and said location of said peak temperature is determined by determining the temperature differentials for the cooling liquid entering and exiting each channel.

5. A method as recited in claim 3 wherein:

said location of said peak temperature is determined by determining the mold heat transfer rate (MHTR) at each of said channels.

6. A method as recited in claim 1 and comprising:

actuating an alarm in response to the detection of a substantial increase in said distance.

7. A method as recited in claim 1 and comprising:

actuating an alarm when said distance is greater than about 3 inches (7.6 cm).

8. A method as recited in claim 1 and comprising:

actuating an alarm when said distance is greater than about 15% of the vertical dimension of said mold.

9. In combination with the method recited in claim 1, the step comprising:

initiating corrective action to prevent a break-out, in response to the detection of a substantial increase in said distance.

10. In the combination of claim 9 wherein said corrective action comprises at least one of the following steps:

(a) decreasing the rate at which said shell is withdrawn from said mold; and (b) raising the molten metal level in said mold.

11. In the combination of claim 10 wherein said corrective action is step (b).

12. In a continuous casting process for forming a cast metal shell, wherein molten metal descends through a vertically disposed, liquid-cooled mold having an upper end, an open lower end, and a predetermined vertical dimension, a method for predicting the likelihood of a molten metal break-out from said shell, at said lower end of the mold, said method comprising the steps of:

providing said mold with a multiplicity of vertically spaced, horizontally disposed, cooling channels at locations between said upper and lower mold ends;

circulating cooling liquid through said channels;

continuously measuring the flow rate of the liquid entering each channel, throughout the casting operation;

continuously measuring the temperature of the liquid entering each channel, throughout the casting operation;

continuously measuring the temperature of the liquid exiting each channel, separately for each of said channels, throughout the casting operation;

continuously calculating, from the measurements obtained in said three above-recited measuring steps, the mold heat transfer rate (MHTR) at each of said channels;

continuously determining the molten metal level location in said mold, throughout the casting operation;

plotting, on a graph in which one coordinate is said MHTR and the other coordinate is the vertical distance from the top of the mold, a curve showing the MHTR along said vertical dimension between said upper and lower ends of the mold;

depicting, on said graph, the location of said molten metal level in relation to the top of the mold;

periodically changing said curve to reflect change in said MHTRs;

periodically changing the depiction on said graph of said molten metal level location, to reflect change in the location of said molten metal level in relation to the top of the mold;

noting from said curve the location of the peak MHTR in relation to the top of the mold;

noting, from the information represented on said graph, the vertical distance between (a) said peak MHTR location and (b) said molten metal level location;

and continuously monitoring said vertical distance to detect any increase in said distance.

13. In a continuous casting process for forming a cast metal shell, wherein molten metal descends through a vertically disposed, liquid-cooled mold having an upper end, an open lower end, and a predetermined vertical dimension, a method for predicting the likelihood of a molten metal break-out from said shell, at said lower end of the mold, said method comprising the steps of:

providing said mold with a multiplicity of vertically spaced, horizontally disposed, cooling channels at locations between said upper and lower mold ends;

circulating cooling liquid at the same flow rate through each of said channels;

continuously measuring the temperature of the liquid entering each channel, throughout the casting operation;

continuously measuring the temperature of the liquid exiting each channel, separately for each of said channels, throughout the casting operation;

continuously calculating, for each of said channels, the temperature differential of the cooling liquid which circulated through that channel;

continuously determining the molten metal level location in said mold, throughout the casting operation;

plotting, on a graph in which one coordinate is said temperature differential and the other coordinate is the vertical distance from the top of the mold, a curve showing the temperature differential along said vertical dimension between said upper and lower ends of the mold;

depicting, on said graph, the location of said molten metal level in relation to the top of the mold;

periodically changing said curve to reflect change in said temperature differentials;

periodically changing the depiction on said graph of said molten metal level location to reflect change in the location of said molten metal level in relation to the top of the mold;

noting from said curve the location of the peak temperature differential, in relation to the top of the mold;

noting, from the information represented on said graph, the vertical distance between (a) said peak temperature differential location and (b) said molten metal level location;

and continuously monitoring said vertical distance to detect any increase in said distance.

14. A method as recited in any of claims 12 and 13 wherein said periodic changing of said curve occurs at a time interval less than ten seconds.

15. A method as recited in claim 14 wherein said periodic changing of said depiction of the molten metal level location occurs at a time interval less than ten seconds.

16. A method as recited in claim 14 wherein said time interval is less than about five seconds.

17. A method as recited in claim 15 wherein said time interval is less than about five seconds.

18. In a continuous casting process for forming a cast metal shell, wherein molten metal descends through a vertically disposed, liquid-cooled mold having walls, an upper end, an open lower end, and a predetermined vertical dimension, a method for predicting the likelihood of a molten metal break-out from said shell, at said lower end of the mold, said method comprising the steps of:

continuously measuring the wall temperature of the mold at each of a multiplicity of vertically spaced locations between said upper and lower mold ends;

continuously determining the molten metal level location in said mold, throughout the casting operation;

plotting, on a graph in which one coordinate is said mold wall temperature and the other coordinate is the vertical distance from the top of the mold, a curve showing the mold wall temperature along said vertical dimension between said upper and lower ends of the mold;

depicting, on said graph, the location of said molten metal level in relation to the top of the mold;

periodically changing said curve to reflect change in said mold wall temperatures;

periodically changing the depiction on said graph of said molten metal level location to reflect change in the location of said molten metal level in relation to the top of the mold;

noting from said curve the location of the peak mold wall temperature, in relation to the top of the mold;

noting, from the information represented on said graph, the vertical distance between (a) said peak mold wall temperature location and (b) said molten metal level location;

and continuously monitoring said vertical distance to detect any increase in said distance.

19. In continuous casting equipment for forming a cast metal shell from molten metal wherein said equipment includes a vertically disposed mold having walls, an upper end and an open lower end, and said mold has a predetermined vertical dimension, apparatus for predicting the likelihood of a molten metal break-out from said shell, at said lower end of the mold, said apparatus comprising:

means for continuously determining the location of the molten metal level in said mold, in relation to the top of the mold;

means for continuously determining the location of the peak temperature within said mold, in relation to the top of the mold;

means for noting the vertical distance between (a) said peak temperature location and (b) said molten metal level location;

and means for continuously monitoring said vertical distance to detect an increase therein.

20. Apparatus as recited in claim 19 wherein said means for determining the location of said peak temperature comprises:

a multiplicity of temperature sensor means located in the mold wall at vertically spaced locations between said upper and lower mold ends.

21. Apparatus as recited in claim 19 and comprising:

a multiplicity of vertically spaced, horizontally disposed, cooling channels in said mold at locations between said upper and lower mold ends;

and means for circulating a cooling fluid through each of said channels.

22. Apparatus as recited in claim 21 and comprising:

means for circulating said cooling liquid at the same flow rate through each of said channels;

said means for determining said peak temperature location comprising means for determining the temperature differentials for the cooling liquid entering and exiting each channel.

23. Apparatus as recited in claim 21 wherein said means for determining said peak temperature location comprises:

means for determining the mold heat transfer rate (MHTR) for each of said channels.

24. Apparatus as recited in claim 19 and comprising:

means for actuating an alarm in response to the detection of a substantial increase in said distance.

25. Apparatus as recited in claim 19 and comprising:

means for actuating an alarm when said distance is greater than about 3 inches (7.6 cm).

26. Apparatus as recited in claim 19 and comprising:

means for actuating an alarm when said distance is greater than about 15% of the vertical dimension of said mold.

27. In continuous casting equipment for forming a cast metal shell from molten metal wherein said equipment includes a vertically disposed mold having an upper end and an open lower end, and said mold has a predetermined vertical dimension, apparatus for predicting the likelihood of a molten metal break-out from said shell, at said lower end of the mold, said apparatus comprising:

a multiplicity of vertically spaced, horizontally disposed, cooling channels in said mold at locations between said upper and lower mold ends;

means for circulating cooling liquid through said channels;

means for continuously measuring the flow rate of the liquid entering each channel;

means for continuously measuring the temperature of the liquid entering each channel;

means for continuously measuring, separately for each channel, the temperature of the liquid exiting each channel;

means for continuously determining the molten metal level location in said mold;

computer means;

means for feeding each of said temperatures and flow rate measurements into said computer means;

means for feeding the molten metal level determination into said computer means;

said computer means comprising each of the following elements (a)–(i):

(a) means for calculating, from the temperature and flow rate measurements fed into said computer means, the mold heat transfer rate (MHTR) at each of said channels;

(b) means for displaying a graph in which one coordinate is said MHTR and the other coordinate is the vertical distance from the top of the mold;

(c) means for plotting, on said graph, a curve showing the variation in MHTR along said vertical dimension between said upper and lower ends of the mold;

(d) means for depicting, on said graph, the location of said molten metal level in relation to the top of the mold;

(e) means for periodically changing said curve to reflect change in said MHTR's;

(f) means for periodically changing the depiction on said graph of said molten metal level location, to reflect change in the location of said molten metal level in relation to the top of the mold;

(g) means for noting the location on said curve of the peak MHTR, in relation to the top of the mold;

(h) means for noting, from the information represented on said curve, the vertical distance between said peak MHTR location and said molten metal level location;

(i) and means for continuously monitoring said vertical distance to detect any increase in said distance.

28. In continuous casting equipment for forming a cast metal shell from molten metal wherein said equipment includes a vertically disposed mold having an upper end and an open lower end, and said mold has a predetermined vertical dimension, apparatus for predicting the likelihood of a molten metal break-out from said shell, at said lower end of the mold, said apparatus comprising:

a multiplicity of vertically spaced, horizontally disposed, cooling channels in said mold at locations between said upper and lower mold ends;

means for circulating cooling liquid at the same flow rate through each of said channels;

means for continuously measuring the temperature of the liquid entering each channel;

means for continuously measuring, separately for each channel, the temperature of the liquid exiting each channel;

means for continuously determining the molten metal level location in said mold;

computer means;

means for feeding each of said temperature measurements into said computer means;

means for feeding the molten metal level determination into said computer means;

said computer means comprising each of the following elements (a)–(i):

(a) means for calculating, for each of said cooling channels, the temperature differential of the cooling liquid which circulated through that channel;

(b) means for displaying a graph in which one coordinate is said temperature differential and the other coordinate is the vertical distance from the top of the mold;

(c) means for plotting, on said graph, a curve showing the temperature differential along said vertical dimension between said upper and lower ends of the mold;

(d) means for depicting, on said graph, the location of said molten metal level in relation to the top of the mold;

(e) means for periodically changing said curve to reflect change in said temperature differentials;

(f) means for periodically changing the depiction on said graph of said molten metal level location, to reflect change in the location of said molten metal level in relation to the top of the mold;

(g) means for noting the location on said curve of the peak temperature differential, in relation to the top of the mold;

(h) means for noting, from the information represented on said curve, the vertical distance between said peak temperature differential location and said molten metal level location;

(i) and means for continuously monitoring said vertical distance to detect any increase in said distance.

29. In continuous casting equipment for forming a cast metal shell from molten metal wherein said equipment includes a vertically disposed mold having walls, an upper end and an open lower end, and said mold has a predetermined vertical dimension, apparatus for predicting the likelihood of a molten metal break-out from said shell, at said lower end of the mold, said apparatus comprising:

means for continuously measuring the wall temperature of the mold at each of a multiplicity of vertically spaced locations between said upper and lower mold ends;

means for continuously determining the molten metal level location in said mold;

computer means;

means for feeding each of said temperature measurements into said computer means;

means for feeding the molten metal level determination into said computer means;

said computer means comprising each of the following elements (a)–(h):

(a) means for displaying a graph in which one coordinate is said mold wall temperature and the other coordinate is the vertical distance from the top of the mold;

(b) means for plotting, on said graph, a curve showing said mold wall temperature along said vertical dimension between said upper and lower ends of the mold;

(c) means for depicting, on said graph, the location of said molten metal level in relation to the top of the mold;

(d) means for periodically changing said curve to reflect change in said mold wall temperatures;

(e) means for periodically changing the depiction on said graph of said molten metal level location, to reflect change in the location of said molten metal level in relation to the top of the mold;

(f) means for noting the location on said curve of the peak mold wall temperature, in relation to the top of the mold;

(g) means for noting, from the information represented on said curve, the vertical distance between said peak mold wall temperature location and said molten metal level location;

(h) and means for continuously monitoring said vertical distance to detect any increase in said distance.

* * * * *